United States Patent [19]

Kawai

[11] Patent Number: 4,834,056

[45] Date of Patent: May 30, 1989

[54] IGNITION COIL UNIT FOR INTERNAL COMBUSTION ENGINES

[75] Inventor: Kazuhide Kawai, Kariya, Japan

[73] Assignee: Nippondenso Co., Ltd., Kariya, Japan

[21] Appl. No.: 233,853

[22] Filed: Aug. 18, 1988

Related U.S. Application Data

[63] Continuation of Ser. No. 851,152, Apr. 14, 1986, abandoned.

[30] Foreign Application Priority Data

Apr. 17, 1985 [JP] Japan ..... 60-81947

[51] Int. Cl.[4] ..... F02P 3/00

[52] U.S. Cl. ..... 123/634; 123/635

[58] Field of Search ..... 123/635, 634, 647, 643

[56] References Cited

U.S. PATENT DOCUMENTS

| | | | |
|---|---|---|---|
| 3,935,852 | 2/1976 | Donovan et al. | 123/635 |
| 4,378,004 | 3/1983 | Petrie | 123/643 |
| 4,392,473 | 7/1983 | Tsutsui et al. | 123/635 |
| 4,515,141 | 5/1985 | Saaf et al. | 123/647 |

FOREIGN PATENT DOCUMENTS

| | | | |
|---|---|---|---|
| 1007116 | 4/1957 | Fed. Rep. of Germany | 123/634 |
| 1498942 | 1/1978 | United Kingdom | 123/635 |

OTHER PUBLICATIONS

Journal of Nippondenso Technical Disclosure #38-175, 11/15/84.

Journal of Nippondenso Technical Disclosure #30-032, 4/20/83.

*Primary Examiner*—Andrew M. Dolinar

*Attorney, Agent, or Firm*—Cushman, Darby & Cushman

[57] ABSTRACT

In a distributorless ignition system for an internal combustion engine, a single ignition coil unit, detachably mountable to a cylinder head, is provided for each pair of spark plugs. The ignition coil unit includes a coil portion having a core and primary and secondary windings wound on the core, a pair of plug couplers formed on the coil portion in correspondence to the spark plugs arranged on adjacent two cylinders of the engine, a pair of high tension couplers formed on the coil portion in directions different from those of the plug couplers, a first connecting member for electrically connecting one end of the secondary winding to one of the plug couplers, a second connecting member for electrically connecting the other end of the secondary winding to one of the high tension couplers, and a third connecting member for electrically connecting the other of the plug couplers to the other of the high tension couplers. Therefore, the ignition coil unit can be easily engaged and disengaged with the spark plugs. Then, a pair of connecting cords are crossed between two such ignition coil units to respectively interconnect different pairs of the high tension couplers. When each of the coil units generates high voltages in a predetermined sequence, the plurality of spark plugs are fired in a given order.

23 Claims, 2 Drawing Sheets

IGNITION COIL UNIT FOR INTERNAL COMBUSTION ENGINES

This is a continuation of application Ser. No. 851,152, filed Apr. 14, 1986, which was abandoned upon the filing hereof.

BACKGROUND OF THE INVENTION

1. Field of the Invention

The present invention relates to an ignition coil unit for use in a distributorless ignition system for an internal combustion engine and more particularly to an ignition coil unit arranged in the vicinity of the associated spark plugs of an engine.

2. Description of the Related Art

With a known distributorless ignition system of the type in which a high voltage is supplied to each spark plug from an ignition coil through a high tension cord, if, for example, the plurality of ignition coils are each arranged above one of the spark plugs by utilizing the unused space between the two camshafts of a double overhead cam (DOHC) type engine, a high tension cord is arranged within the extremely small space between the ignition coil and the spark plug with the resulting deterioration of the mounting property and mounting efficiency of the ignition coils.

Thus, an ignition system has been proposed in the past in which the ignition coil and the spark plug are connected with an integral supply plate to make the system more compact (e.g., Nippondenso Open Giho, Code No. 38-175, published on Nov. 15, 1984). This conventional ignition system is disadvantageous in that the supply plates are arranged at the bottom of the small unused space between the two camshafts and therefore the mounting or demounting of the supply plates during the assembling or inspection of the spark plugs is not easy.

Also, an ignition system has been proposed in which a single ignition coil is provided for each pair of spark plugs in such a manner that one of the high tension couplers of each ignition coil is directly connected to one spark plug and the other high tension coupler is connected to the other spark plug through a high tension cord (e.g., Nippondenso Open Giho, Code No. 30-032, published on Apr. 20, 1983). This conventional ignition system is disadvantageous in that since the other high tension coupler of the ignition coil is connected to the other spark plug through the high tension cord, it is difficult to mount and demount the high tension cords within the small space.

SUMMARY OF THE INVENTION

It is an object of the present invention to provide an ignition coil unit which is excellent in mounting property and mounting efficiency and whose high tension couplers are easy for engaging and disengaging of the coil unit during the inspection of the spark plugs.

To accomplish the above object, in accordance with the invention there is thus provided an ignition coil unit for an ignition system of an internal combustion engine including a coil portion having a core and primary and secondary windings wound on the core, a pair of plug couplers provided on the coil portion in correspondence to a pair of spark plugs each fitted into one of the two adjacent cylinders of the engine, a pair of high tension couplers provided on the coil portion in directions different from those of the plug couplers, a first connecting member for electrically interconnecting one end of the secondary winding and one of the plug couplers, a second connecting member for electrically interconnecting the other end of the secondary winding and one of the high tension couplers, and a third connecting member for electrically interconnecting the other plug coupler and the other high tension coupler.

In accordance with the above-mentioned construction of the invention, a single ignition coil unit is provided for each pair of spark plugs in such a manner that each of a pair of plug couplers provided on the ignition coil unit is directly connected to the corresponding spark plug and the spark plugs are connected to the ignition coil portion with one end of its secondary winding being connected electrically to one of the spark plugs. Also, the other spark plug is supplied with a high voltage through one of a pair of high tension couplers of the ignition coil unit from the other ignition coil unit. Further, the other end of the secondary winding is connected through the other high tension coupler to one of a pair of high tension couplers of the other ignition coil unit. Therefore, each of the spark plugs is connected to the given ignition coil unit through the plug coupler or the high tension coupler and the plug coupler and also each spark plug is connected directly to one of the plug couplers of the ignition coil unit.

In accordance with the invention, by virtue of the fact that one end of a secondary winding of an ignition coil portion is directly connected to one of a pair of spark plugs through one of a pair of plug couplers and the other end of the secondary winding is connected to another spark plug through one of a pair of plug couplers of the other ignition coil unit, that the pair of spark plugs are directly coupled to the pair of plug couplers of the ignition coil unit and that the ignition coil units are connected to each other through their high tension couplers provided in directions different from those of the plug couplers, there is an effect that the ignition coil unit can be arranged in the comparatively small space around the spark plugs with excellent mounting property and efficiency and the operation of disengaging and engaging the connections of the high tension couplers during the inspection of the spark plugs is easy.

DESCRIPTION OF THE PREFERRED EMBODIMENTS

Figure 1:
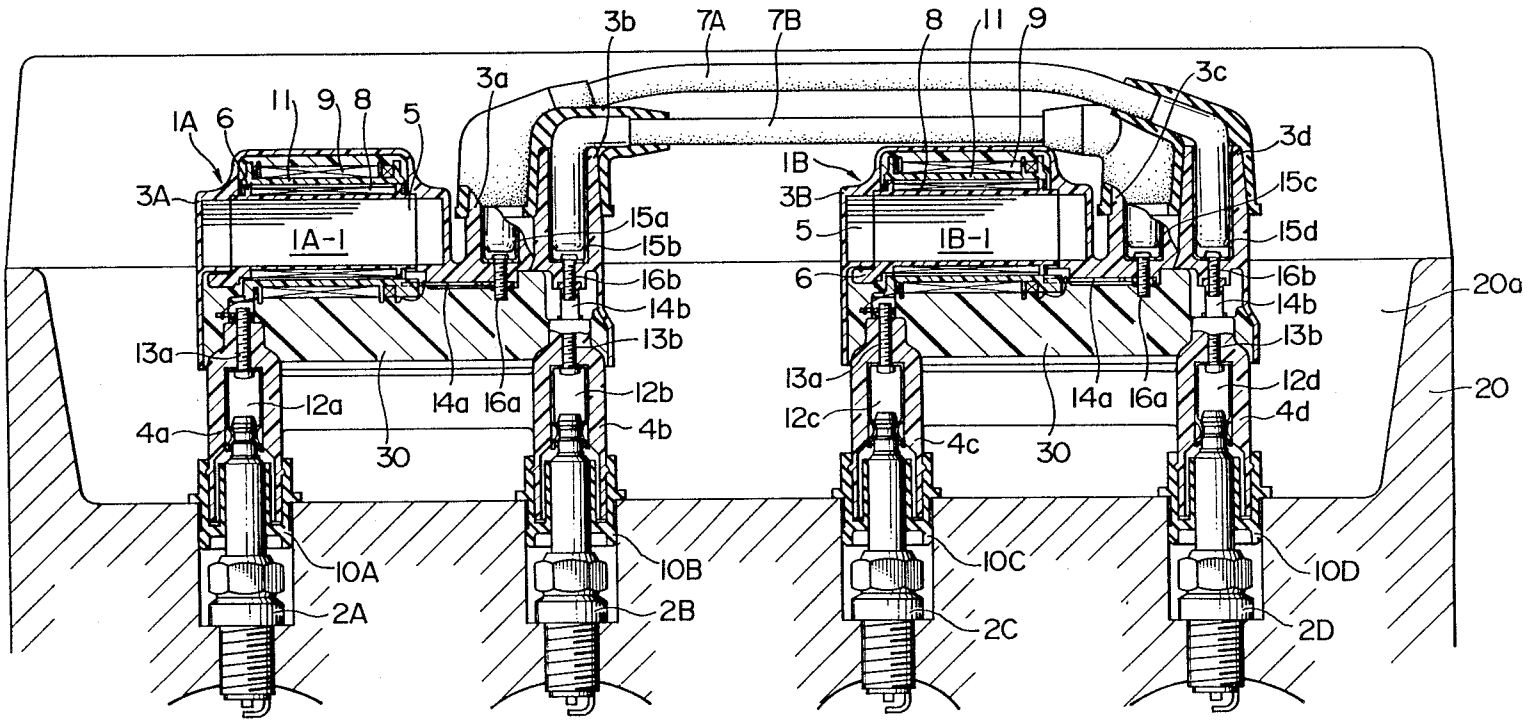
FIG. 1 is a longitudinal sectional view showing the manner in which an ignition coil unit according to the invention is mounted in an internal combustion engine.
Figure 2:
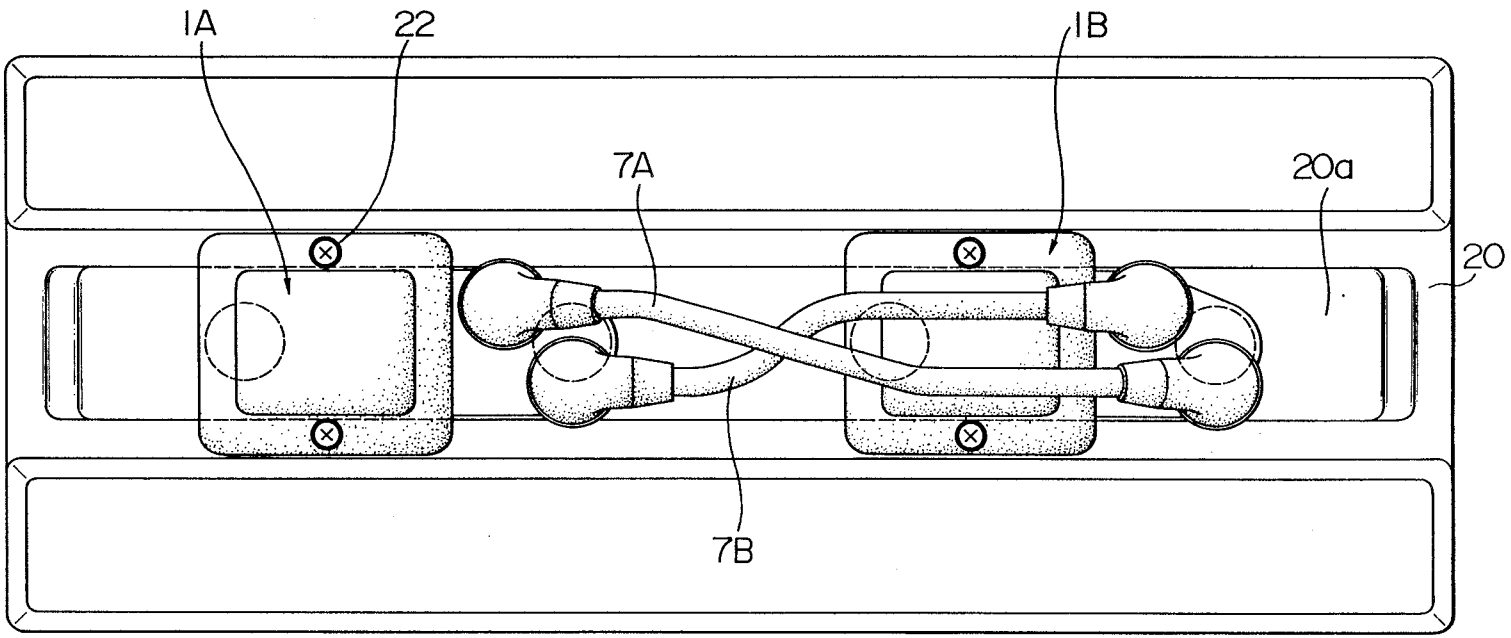
FIG. 2 is a plan view showing the manner in which the ignition coil unit of the invention is mounted in the engine.

The present invention will now be described with reference to the illustrated embodiment. Referring to FIGS. 1 and 2, numeral 20 designates the cylinder head of a DOHC type four-cylinder engine which is provided with a recessed bank 20*a* in its upper intermediate portion (between the two camshafts). Fitted into the bottom portion of the bank 20*a* are four spark plugs 2A to 2D arranged at substantially the same intervals in correspondence to the respective cylinders of the engine. Also, in the upper part of the bank 20*a*, two ignition coil units 1A and 1B are respectively arranged between spark plugs 2A and 2B and between spark plugs 2C and 2D, and the coil units 1A and 1B are fastened to the cylinder head 20 with screws 22.

The ignition coil units 1A and 1B are respectively provided with insulating-resin cases 3A and 3B each of which is formed at its upper one end with a pair of integral cylindrical high tension towers 3*a* and 3*b* or 3*c* and 3*d* projected upward to form a pair of high tension couplers. Also, the ignition coil units 1A and 1B are each formed on its lower part with a pair of insulating-resin cylindrical high tension towers 4*a* and 4*b* or 4*c* and 4*d* forming a pair of plug couplers and projected downward to align with the centers of the spark plugs 2A and 2B or 2C and 2D and caps 10A to 10D which are made of elastic material such as rubber and are respectively fitted firmly on the high tension towers 4*a* to 4*d*. Each of the caps 10A to 10D is formed with a central hole which is slightly smaller than the insulator outer diameter of the spark plugs 2A to 2D and they are respectively force fitted firmly on the spark plugs 2A to 2D. The outer surfaces of the portions of the caps 10A to 10D engaging with the spark plugs 2A to 2D are arranged to form a gap of 0.5 to 2 mm with respect to the inner surfaces of the high tension towers 4*a* to 4*d* and therefore the spark plugs 2A to 2D can be satisfactorily engaged with the high tension towers 4*a* to 4*d* irrespective of any misalignment therebetween.

Also, conductive contactors 12*a* to 12*d* for contacting with the terminals at the tops of the spark plugs 2A to 2D, respectively, are respectively arranged within the lower high tension towers 4*a* to 4*d* and the high tension towers 4*a* and 4*c* of the ignition coil unit 1A and 1B are fastened, along with the contactors 12*a* and 12*c*, by conductor screws 13*a* to portions of insulating resin secondary bobbin 11 within the insulating coil units 1A and 1B, respectively. Also, each of the contactors 12*a* and 12*c* is electrically connected to one contactors 12*a* and 12*c* is electrically connected to one end of the corresponding secondary winding 9. The other end of each secondary winding 9 is connected by a conductor screw 16*a* to a terminal 15*a* or 15*c* in the high tension tower 3*a* or 3*c* at the top of the ignition coil unit 1A or 1B through a conductive connecting plate 14*a* fastened to the secondary bobbin 11. Also, with the remaining lower high tension towers 4*b* and 4*d*, each of the contactors 12*b* and 12*d* is connected to a conductive connecting plate 14*b* by a conductor screw 13*b* and each of the connecting plates 14*b* is connected by a conductor screw 16*b* to the high tension tower 3*b* or 3*d* at the top of the ignition coil unit 1A or 1B.

Coil portions 1A-1 and 1B-1 of the ignition coil units 1A and 1B are each composed of a closed magnetic circuit core 5, an insulating-resin primary bobbin 6 formed on the outer surface of the central magnetic path portion of the core 5, a primary winding 8 wound on the outer surface of the primary bobbin 6 and the secondary winding 9 split wound on the outer surface of the secondary bobbin 11, and the coil portions 1A-1 and 1B-1 are respectively accommodated within the cases 3A and 3B each having an open end on the side of the lower high tension towers 4*a* and 4*b* or 4*c* and 4*d*. A resin 30 such as epoxy resin is poured into the cases 3A and 3B for potting.

In the ignition coil units 1A and 1B, the terminals 15*a* to 15*d* of the upper high tension towers 3*a* to 3*d* are each cross connected so as to be interconnected with different ones of them by a high tension cord 7A or 7B between the ignition coil units 1A and 1B. In other words, the high tension cord 7A interconnects the terminals 15*a* and 15*d* and the high tension cord 7B interconnects the terminals 15*b* and 15*c*.

With the construction described above, a high voltage is induced alternately in the respective secondary windings 9 of the ignition coil units 1A and 1B, with the result that the high voltage is applied from the contactor 12*a* or 12*c* of the lower high tension tower 4*a* or 4*c* and the terminal 15*a* or 15*c* of the upper high tension tower 3*a* or 3*c* of the ignition coil unit 1A or 1B to the terminal 15*d* or 15*b* in the other upper high tension tower 3*d* or 3*b* of the other corresponding ignition coil through the high tension cord 7A or 7B and is then supplied to the spark plugs 2D or 2B through the screw 16*b*, the connecting plate 14*b*, the screw 13*b* and the contactor 12*d* or 12*b* of the other lower higher tension tower 4*d* or 4*b*. In this way, the high voltage is supplied to each of the spark plugs 2A to 2D thereby producing an ignition spark at each of the spark plugs 2A to 2D.

As a result, an ignition spark is first produced simultaneously at each of the spark plugs 2A and 2D respectively arranged on the No. 1 and No. 4 cylinders of the engine so that the mixture in the No. 1 cylinder on the compression stroke is ignited by the ignition spark produced at the spark plug 2A and the No. 4 cylinder on the exhaust stroke is not fired due to the presence of no mixture. Then, an ignition spark is produced simultaneously at each of the spark plugs 2B and 2C respectively arranged on the No. 2 and No. 3 cylinders so that the mixture in the No. 3 cylinder on the compression stroke is ignited by the ignition spark produced at the spark plug 2C on the No. 3 cylinder and the No. 2 cylinder on the exhaust stroke is not fired. Then, an ignition spark is produced at each of the spark plugs 2A and 2D arranged on the No. 1 and No. 4 cylinders thus igniting the mixture in the No. 4 cylinder on the compression stroke and then an ignition spark is produced at each of the spark plugs 2B and 2C arranged on the No. 2 and No. 3 cylinders thus igniting the mixture in the No. 2 cylinder on the compression stroke.

In this way, the cylinders of the engine are successively fired to move onto the explosion stroke in accordance with the firing order of 1-3-4-2 and the mixtures in the respective cylinders of the engine are successively ignited without using any distributor.

In accordance with this embodiment, the ignition coil units 1A and 1B are mounted in such a manner that their caps 10A to 10D are respectively force fitted on the spark plugs 2A to 2D arranged on the respective cylinders of the engine and then, after the ignition coil units 1A and 1B have been fastened to the cylinder head 20 with the screws 22, the high tension cords 7A and 7B are arranged to respectively interconnect the terminals 15*a*, 15*d* and 15*b*, 15*c* in the upper high tension towers 3*a* to 3*d* of the ignition coil units 1A and 1B thus completing the mounting.

While, in the above-described embodiment, the ignition coil units 1A and 1B are interconnected with the high tension cords 7A and 7B, the ignition coils may be interconnected with plate connectors of resin or the like containing conductors. Further, the upper high tension towers 3*a* to 3*d* of the ignition coil units 1A and 1B may be arranged on the sides of the ignition coil units 1A and 1B so as to provide a connection between the high tension towers 3*a* and 3*d* and 3*b* and 3*c*, respectively, of the ignition coil units 1A and 1B directly or through the plate connectors or the high tension cords.

Still further, while in the above-described embodiment the lower high tension towers 4*a* to 4*d* are fastened to the ignition coil units 1A and 1B by the screws 13*a* and 13*b* and the potting by the resin 30, they may be formed integral with the cases 3A and 3B of the ignition coil units 1A and 1B.

Still further, while the above-described embodiment is directed to a four-cylinder engine, the invention may be applied to a six-cylinder engine by constructing the required distributorless ignition system by simply adding to the above-described four-cylinder engine ignition coil unit arrangement another ignition coil unit whose secondary winding has its ends connected to contactors in lower high tension towers.

Furthermore, if this invention may be applied to a two-cylinder engine, the ignition coil unit has only lower first and second high tension towers as plug couplers, and ends of a secondary coil in the ignition coil unit are connected to the first and second high tension towers, respectively.

I claim:

1. An ignition coil unit for use in a multicylinder internal combustion engine having a spark plug for each cylinder thereof comprising:

a coil portion having a core and primary and secondary windings wound on said core;

first and second plug coupling means formed on said coil portion to project therefrom so as to be respectively fitted on the spark plugs of adjacent two of said cylinders;

first and second high tension coupling means formed on said coil portion to project therefrom in directions different from the projecting directions of said plug coupling means;

first connecting means for electrically connecting one end of said secondary winding to said first plug coupling means;

second connecting means for electrically connecting the other end of said secondary winding to said first high tension coupling means;

third connecting means for electrically connecting said second plug coupling means to said second high tension coupling means; and means for fixedly mounting said coil portion to said engine.

2. An ignition coil unit according to claim 1, wherein an axial direction of said core of said coil portion is horizontal, and wherein said first and second plug coupling means are arranged at end positions of said coil portion to project in the same direction.

3. An ignition coil unit according to claim 1, wherein said high tension coupling means and said plug coupling means are respectively arranged in directions opposite to each other.

4. An ignition coil unit according to claim 1, wherein said first and second high tension coupling means are arranged adjacent to each other.

5. An ignition coil unit according to claim 1, wherein said primary and secondary windings are coaxially wound on said core.

6. An ignition coil unit according to claim 1, wherein each of said first and second plug coupling means includes an elastic cap at a forward end thereof.

7. An ignition coil unit according to claim 1, wherein a case of said ignition coil unit is filled with a resin to integrally fix in place said component parts of said ignition coil unit.

8. An ignition coil unit for use in a multicylinder internal combustion engine including a spark plug for each cylinder thereof and a cylinder head formed with a recessed bank comprising:

a coil portion having a closed magnetic circuit core and primary and secondary windings wound on said core, said coil portion being shaped so as to be accommodated in said bank;

first and second plug coupling means formed on said coil portion to project therefrom so as to be respectively fitted on the spark plugs of adjacent two of said cylinders;

first and second high tension coupling means formed on said coil portion to project therefrom in directions different from the projecting directions of said plug coupling means;

first connecting means for electrically connecting one end of said secondary winding to said first plug coupling means;

second connecting means for electrically connecting the other end of said secondary winding to said first high tension coupling means;

third connecting means for electrically connecting said second plug coupling means to said second high tension coupling means; and means for fixedly mounting said coil portion to said engine in said bank.

9. An ignition coil unit according to claim 8, wherein an axial direction of said core of said coil portion is horizontal, and wherein said first and second plug coupling means are respectively arranged at end positions of said coil portion to project in the same direction.

10. An ignition coil unit according to claim 8, wherein said high tension coupling means and said plug coupling means are respectively arranged in directions opposite to each other.

11. An ignition coil unit according to claim 8, wherein said first and second high tension coupling means are arranged adjacent to each other.

12. An ignition coil unit according to claim 8, wherein said primary and secondary windings are coaxially wound on said core.

13. An ignition coil unit according to claim 8, wherein each of said first and second plug coupling means includes an elastic cap at a forward end thereof.

14. An ignition coil unit according to claim 8, wherein a case of said ignition coil unit is filled with a resin to integrally fix in place said component parts of said ignition coil unit.

15. An ignition coil unit for a distributorless ignition system used in an internal combustion engine including at least first and second cylinders each having a spark plug and a cylinder head formed with a recessed bank having elongated side walls, for supplying a high voltage to each of said spark plugs, said coil unit comprising:

a coil portion having a closed magnetic circuit core and primary and secondary windings wound on said core, said coil portion being shaped so as to be accommodated in the space between said elongated side walls;

first and second plug coupling means adapted to be respectively fitted on the spark plugs of said first and second cylinders;

first connecting means for directly electrically connecting one end of said secondary winding to said first plug coupling means;

second connecting means for directly electrically connecting the other end of said secondary winding to said second plug coupling means; and means for fixedly mounting said coil portion to said engine in said bank.

16. An ignition coil unit for a distributorless ignition system used in an internal combustion engine including at least first and second cylinders each having a spark plug and a cylinder head formed with a recessed bank having elongated side walls, for supplying a high voltage to each of said spark plugs, said coil unit comprising:

a coil portion having a closed magnetic circuit core and primary and secondary windings wound on said core, said coil portion being shaped so as to be accomodated in the space between said elongated side walls;

first plug coupling means formed on said coil portion to project therefrom so as to be fitted on the spark plug of said first cylinder;

second plug coupling means adapted to be fitted on the spark plug of said second cylinder;

high tension coupling means formed on said coil portion to project therefrom in a direction different from the projecting direction of said first plug coupling means;

means for electrically connecting ends of said secondary winding to said first plug coupling means and said high tension coupling means, respectively;

means for electrically connecting said second plug coupling means to said high tension coupling means; and means for fixedly mounting said coil portion to said engine in said bank.

17. An ignition coil unit for use in an internal combustion engine including at least four cylinders each having a spark plug, said coil unit comprising:

first and second coil portions each having a core and primary and secondary windings wound on said core;

first and second plug coupling means formed on said first coil portion to project therefrom so as to be respectively fitted on the spark plugs of adjacent two of said cylinders;

third and fourth plug coupling means formed on said second coil portion so as to be respectively fitted on the spark plugs of the other adjacent two of said cylinders;

first and second high tension coupling means formed on said first coil portion to project therefrom in directions different from the projecting directions of said first and second plug coupling means;

third and fourth high tension coupling means formed on said second coil portion to project therefrom in directions different from the projecting directions of said third and fourth plug coupling means;

a first high tension cord for electrically connecting said first and fourth high tension coupling means to each other;

a second high tension cord for electrically connecting said second and third high tension coupling means to each other;

first connecting means for electrically connecting each of said first and third plug coupling means to one end of a corresponding one of said secondary windings of said coil portions;

second connecting means for electrically connecting each of said first and third high tension coupling means to the other end of the corresponding one of said secondary windings; and third connecting means for electrically connecting said second and fourth plug coupling means to said second and fourth high tension coupling means, respectively.

18. An ignition coil unit according to claim 17, wherein an axial direction of each of said cores of said coil portions is horizontal, and wherein said plug coupling means of each said coil portion are arranged at end positions thereof to project in the same direction.

19. An ignition coil unit according to claim 17, wherein said high tension coupling means and said plug coupling means on each of said coil portions are respectively arranged in directions opposite to each other.

20. An ignition coil unit according to claim 17, wherein said high tension coupling means on each of said coil portions are arranged adjacent to each other.

21. An ignition coil unit according to claim 17, wherein said primary and secondary windings of each of said cores are coaxially wound thereon.

22. An ignition coil unit according to claim 17, wherein each of said plug coupling means includes an elastic cap at a forward end thereof.

23. An ignition coil unit according to claim 17, wherein a case of each of said coil portions is filled with a resin to integrally fix in place said component parts of said first and second coil portions.

* * * * *